US010731446B2

(12) United States Patent
Stachowiak et al.

(10) Patent No.: US 10,731,446 B2
(45) Date of Patent: Aug. 4, 2020

(54) DIVERSION PLUNGER FOR RECIPROCATING ROD PUMP

(71) Applicant: Weatherford Technology Holdings, LLC, Houston, TX (US)

(72) Inventors: John E. Stachowiak, Houston, TX (US); Jason W. Bailey, Houston, TX (US); Doug Hebert, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 405 days.

(21) Appl. No.: 15/044,856

(22) Filed: Feb. 16, 2016

(65) Prior Publication Data

US 2016/0237796 A1 Aug. 18, 2016

Related U.S. Application Data

(60) Provisional application No. 62/116,812, filed on Feb. 16, 2015.

(51) Int. Cl.
*E21B 43/12* (2006.01)
*F04B 47/00* (2006.01)
(Continued)

(52) U.S. Cl.
CPC ..... *E21B 43/127* (2013.01); *F04B 47/005* (2013.01); *F04B 47/02* (2013.01);
(Continued)

(58) Field of Classification Search
CPC ..... E21B 43/127; F04B 47/022; F04B 47/02; F04B 53/10; F04B 53/14; F04B 47/005
See application file for complete search history.

(56) References Cited

U.S. PATENT DOCUMENTS 2,160,811 A 6/1939 Adams
2,723,627 A * 11/1955 Williams ..... F04B 47/00 166/105.2
(Continued)

FOREIGN PATENT DOCUMENTS

CA 2040324 A1 10/1992
WO 0111187 A1 2/2001

OTHER PUBLICATIONS

Weatherford, "Subsurface Rod Pumps, Parts and Accessories," Brochure, copyright 2008-2012.
(Continued)

*Primary Examiner* — Nathan C Zollinger
(74) *Attorney, Agent, or Firm* — Blank Rome LLP

(57) ABSTRACT

A diversion connector is used for a downhole pump having a plunger and a barrel in a well. The diversion connector is useful in a sandy well having particulates. The plunger has an interior and is reciprocated by a rod relative to the barrel. The connector includes one or more bodies, such as a mandrel, attaching the rod to the plunger. The mandrel has a first exterior surface and defines a fluid passage communicating with the interior of the plunger. A sleeve is disposed on the first exterior surface and has an interior surface floating relative to the first exterior surface. The floating sleeve at least partially prevents particulate uphole of the plunger from passing in a gap between the plunger and the barrel.

41 Claims, 10 Drawing Sheets

(51) Int. Cl.
*F04B 47/02* (2006.01)
*F04B 53/10* (2006.01)
*F04B 53/14* (2006.01)

(52) U.S. Cl.
CPC ..... *F04B 47/022* (2013.01); *F04B 53/10* (2013.01); *F04B 53/14* (2013.01)

(56) References Cited

U.S. PATENT DOCUMENTS

| | | | | |
|---|---|---|---|---|
| 2,862,457 | A * | 12/1958 | Williams | F04B 47/005 166/105.2 |
| 5,941,311 | A | 8/1999 | Newton | |
| 6,145,590 | A | 11/2000 | Havard | |
| 7,404,702 | B2 | 7/2008 | Ford | |
| 7,428,923 | B2 | 9/2008 | Ford | |
| 7,540,323 | B2 | 6/2009 | McAnally | |
| 7,686,598 | B2 | 3/2010 | Williams | |
| 7,909,589 | B2 | 3/2011 | Williams | |
| D682,317 | S | 5/2013 | Carruth et al. | |
| D700,622 | S | 3/2014 | Carruth et al. | |
| 8,858,187 | B2 | 10/2014 | Lane | |
| D717,834 | S | 11/2014 | Carruth et al. | |
| D717,835 | S | 11/2014 | Carruth et al. | |
| D724,104 | S | 3/2015 | Carruth et al. | |
| 9,341,183 | B1 * | 5/2016 | Carruth | F04B 47/005 |
| 10,174,752 | B2 * | 1/2019 | Downing | F04B 47/02 |
| 2005/0265875 | A1 | 12/2005 | Williams et al. | |
| 2006/0083646 | A1 | 4/2006 | Ford | |
| 2011/0024370 | A1 * | 2/2011 | Ford | E21B 43/127 210/787 |
| 2015/0376996 | A1 * | 12/2015 | Downing | F04B 47/02 417/514 |

OTHER PUBLICATIONS

Harbison-Fischer, "Rod Pumps and Accessories for Fluid Production with Sand and Particulates," Brochure HF-2-08-2, undated, obtained from www.hfpumps.com on Aug. 9, 2011.

First Office Action in counterpart CA Appl. 2,976,698, dated Apr. 23, 2018, 3-pgs.

International Search Report and Written Opinion received in corresponding PCT patent application No. PCT/US2016/018078, dated May 10, 2016, 10-pgs.

* cited by examiner 20
22
32
34
30
12
19
10
16
18
11
24
14
36
61
50
60
80
90
92
94
31
62
70
72
74
15
F

DIVERSION PLUNGER FOR RECIPROCATING ROD PUMP

CROSS-REFERENCE TO RELATED APPLICATIONS

This application claims the benefit of U.S. Provisional Appl. 62/116,812, filed 16 Feb. 2015, which is incorporated herein by reference in its entirety.

BACKGROUND

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation and inhibits the unassisted flow of production fluid to the surface.

A common approach for urging production fluids to the surface uses a mechanically actuated, positive displacement pump. Reciprocal movement of a string of sucker rods induces reciprocal movement of the pump for lifting production fluid to the surface. For example, a reciprocating rod lift system 20 of the prior art is shown in FIG. 1A to produce production fluid from a wellbore 10. As is typical, surface casing 12 hangs from the surface and has a liner casing 14 hung therefrom by a liner hanger 16. Production fluid F from the formation 19 outside the cement 18 can enter the liner 14 through perforations 15. To convey the fluid, production tubing 30 extends from a wellhead 32 downhole, and a packer 36 seals the annulus between the production tubing 30 and the liner 14. At the surface, the wellhead 32 receives production fluid and diverts it to a flow line 34.

The production fluid F may not naturally reach the surface so operators use the reciprocating rod lift system 20 to lift the fluid F. The system 20 has a surface pumping unit 22, a rod string 24, and a downhole rod pump 50. The surface pumping unit 22 reciprocates the rod string 24, and the reciprocating string 24 operates the downhole rod pump 50. The rod pump 50 has internal components attached to the rod string 24 and has external components positioned in a pump-seating nipple 31 near the producing zone and the perforations 15.

As best shown in the detail of FIG. 1B, the rod pump 50 has a barrel 60 with a plunger 80 movably disposed therein. The barrel 60 has a standing valve 70, and the plunger 80 is attached to the rod string 24 and has a traveling valve 90. For example, the traveling valve 90 is a check valve (i.e., one-way valve) having a ball 92 and seat 94. For its part, the standing 70 disposed in the barrel 60 is also a check valve having a ball 72 and seat 74.

As the surface pumping unit 22 in FIG. 1A reciprocates, the rod string 24 reciprocates in the production tubing 30 and moves the plunger 80. The plunger 80 moves the traveling valve 90 in reciprocating upstrokes and downstroke. During an upstroke, the traveling valve 90 as shown in FIG. 1B is closed (i.e., the upper ball 92 seats on upper seat 94). Movement of the closed traveling valve 90 upward reduces the static pressure within the pump chamber 62 (the volume between the standing valve 70 and the traveling valve 90 that serves as a path of fluid transfer during the pumping operation). This, in turn, causes the standing valve 70 to unseat so that the lower ball 72 lifts off the lower seat 74. Production fluid F is then drawn upward into the chamber 62.

On the following downstroke, the standing valve 70 closes as the standing ball 72 seats upon the lower seat 74. At the same time, the traveling valve 90 opens so fluids previously residing in the chamber 62 can pass through the valve 90 and into the plunger 80. Ultimately, the produced fluid F is delivered by positive displacement of the plunger 80, out passages 61 in the barrel 60. The moved fluid then moves up the wellbore 10 through the tubing 30 as shown in FIG. 1A. The upstroke and down stroke cycles are repeated, causing fluids to be lifted upward through the wellbore 10 and ultimately to the earth's surface.

The conventional rod pump 50 holds pressure during a pumping cycle by using sliding mechanical and/or hydrodynamic seals disposed between the plunger's outside diameter and the barrel's inside diameter. Sand in production fluids and during fracture flowback can damage the seals and surfaces of the plunger 80 and barrel 60. In particular, the differential pressure across the seals and surfaces causes fluid to migrate past the seals. When this migrating fluid contains sand or other solids, the seals and surfaces can become abraded by the sand so the seals eventually become less capable of holding pressure. Overtime, significant amounts of sand can collect between the plunger 80 and the barrel 60, causing the plunger 50 to become stuck within the barrel.

Production operations typically avoid using such a rod pump in wellbores having sandy fluids due to the damage that can result. However, rod pumping in sandy fluids has been a goal of producers and lift equipment suppliers for some time. To prevent sand damage, screens can be disposed downhole from the pump 50 to keep sand from entering the pump 50 altogether. Yet, in some applications, using a screen in such a location may not be feasible, and the screen and the rathole below can become fouled with sand. In other application, it may actually be desirable to produce the sand to the surface instead of keeping it out of the pump 50.

One solution to deal with sandy fluids uses extra tight seals in the pump 50 to exclude the sand. In pumping operations, however, there will always be some fluid leakage due to the pressure differential so eventually the sand will wear the seal. Extra loose hydrodynamic seals with long sealing surfaces are sometimes used to let sand pass. These long, loose hydrodynamic seals can extend the life of the pump because the longer seals can accommodate more damage than conventional rod pumps. However, damage still occurs; there is just more sacrificial surface to accept the damage. Thus, the life of the pump is extended even though damage continues.

Other solutions use features such as cups, wipers, grooved plungers, and diversion type plungers to help alleviate problems associated with sandy fluids. The cups and wipers are made from plastic, rubber, or fiber and may not be suitable in high temperature applications. Grooved plungers have radially tapered grooves that create a funnel for sand to easily find its way into.

For example, one solution to deal with sandy fluids shown in FIG. 2A uses a rod pump 50 as disclosed in U.S. Pat. No. 2,160,811. As before, the rod pump 50 has a plunger 80 disposed in a barrel 60 and has a standing valve 70 and a traveling valve 90. An upper sealing zone 84*a* between the plunger 80 and barrel 60 has hard metal rings 85 that engage inside the barrel 60. A lower sealing zone 84*b* uses the sliding cooperation between the barrel 60 and the plunger 80 to form a fluid seal. A chamber 86 is disposed between the two sealing zones 84*a-b* to deal with sand that may collect uphole of the plunger 80. This chamber 86 is maintained in communication with the interior 82 of the plunger 80 using circumferentially spaced ports 83.

During a downstroke of the plunger 80, the chamber 86 decreases in volume, and fluid displaces from the chamber 86 through the ports 83 and into the interior 82 of the plunger 80. Thus, any sand and silt that may have entered the chamber 86 through the upper sealing zone 84*a* is discharged into the plunger 80 to be removed with the main body of fluid. In this way, the sand or silt is prevented from reaching the lower sealing zone 84*b* and causing damage during a subsequent upstroke.

In a related solution to the rod pump 50 of FIG. 2A, a sand snare chamber can be used in the rod pump. For example, the Harbison-Fischer Sand-Pro® pump disclosed in U.S. Pat. Nos. 7,686,598 and 7,909,589 has a plunger with a sand snare chamber defined in its walls to catch the sand. (SAND-PRO is a registered trademark of Harbison-Fischer, Inc. of Crowley, Tex.) FIG. 2B shows an example of such a rod pump 50 having a sand snare chamber 100.

Again, the pump 50 has a barrel 60 with a plunger 80 located therein and has standing and traveling valves 70 and 90. The plunger 80 has a first portion 83 having a first seal 84*a* with the barrel 60, and the plunger 80 has a third portion 87 having a second seal 84*b* with the barrel 60. The first seal 84*a* has resilient members, while the second seal 84*b* is a fluid seal. An opening 81 at the top of the plunger 80 allows lifted fluid to pass up the barrel 60 and the production tubing (not shown) to be produced.

In between the first and second portions 83 and 87, the plunger 60 has a second portion 85 that forms a balancing chamber 86 between the barrel 60 and the plunger 80. The plunger's second portion 85 also has an opening 88 to allow communication between the plunger's interior 82 and the balancing chamber 86. A wall 89 is located relative to the opening 88 and forms a sand snare chamber 100 between the balancing chamber 86 and the plunger interior passage 82.

To pump fluid from a sandy well, the plunger 80 reciprocates with respect to the barrel 60. Pressure equalizes across the first seals 84*a* by venting pressure from inside of the plunger 82 to outside of the plunger 80 in the balancing chamber 86 between the two seals 84*a-b*. In the meantime, the pump 50 uses the wall 89 to capture sand from the fluid exiting the opening 88 in the sand snare chamber 100. This collection isolates the sand from the sets of seals 84*a-b* to reduce wear.

Unfortunately, the sand snare chamber 100 on the pump 50 has some drawbacks. For example, the volume available to collect sand can be limited. In addition, the chamber 100 can create turbulence during pumping which can tend to keep the sand flushed out of the sand snare chamber 100 and into the sealing areas 84*a-b*.

Yet another solution of a downhole pump for use in sandy fluids is disclosed in U.S. Pat. No. 8,858,187 to Lane.

In another solution briefly mentioned above, a diversion plunger can be used in a rod pump to deal with sandy fluid. FIG. 3A illustrates a typical downhole pump according to the art having a form of diversion plunger. A traveling assembly 150 includes a valve-rod bushing 152, a rod 154, a top connector 156, a plunger 158, a cage 160, a ball valve 162, and a seat 164. A seating assembly includes a cup assembly 112 and a bushing 114, which connects to a stationary assembly having a barrel 116, a cage 118, a ball valve and seat 120, and a barrel-cage bushing 122.

For use, the traveling assembly 150 is disposed in the seating and stationary assembly 110 and can reciprocate therein with a rod string connected to the valve-rod bushing 152. The rod 154 extends out of the cup assembly 112, and the plunger 158 with its top connector 156, cage 160, ball valve 162, and seat 164 is movably disposed inside the barrel 116. The barrel 116 disposes in production tubing with a pump seating nipple or other component as conventionally done, and the pump can be used to lift production fluids of a well to the surface as the plunger 158 reciprocates in the barrel 116.

The barrel 116 defines an interior in which the plunger 158 is disposed, and the plunger 158 defines an interior as well. The standing valve 120 permits fluid flow from the production tubing (not shown) to flow into the barrel's interior, but restricts fluid flow in the opposite direction. The traveling valve 162 permits fluid flow from the barrel's interior (and especially a variable volume between the valves 162 and 120) to enter the plunger's interior, but restricts fluid flow in the opposite direction.

A gap is formed between the plunger 158 and the barrel 116, and a fluid or hydrodynamic seal that uses the fluid trapped in the gap can hold pressure. As noted above, the hydrodynamic seal can be formed by long sealing surfaces along the plunger 158 and the barrel 116, which can help deal with sandy fluids. Additionally, the outside surface of the plunger 158 can be hardened with a coating or the like to increase resistance to wear. Typically, the inside surface of the barrel 116 and the outside surface of the plunger 158 have a tight clearance to create the fluid seal. The actual clearance can depend in part on the type of fluid to be encountered, such as heavy or light crude, expected particulate sizes, and other details of the pump.

In the rod pumping application, sand can migrate between the barrel 116 and the plunger 158 and can cause damage/scoring to the plunger 158 and/or barrel 116, which eventually leads to poor pumping efficiency and pump failure. To help mitigate damage, the pump 50 can use features of the top connector 156 for the plunger 158. As shown, the top connector 156 is threaded onto the upper end of the plunger 158. The top connector 156 not only connects to the rod 154, but reciprocates with the plunger 158 in the barrel 116 and provides outlets 157 for lifted fluid from the interior 159 of the plunger 158.

FIG. 3B shows an example of a current top connector 200 for a diversion plunger. The top connector 200 includes a body 210 with a flow passage 212 therethrough. A threaded end 214 of the flow passage 212 threads onto an uphole end of the plunger 158, and outlet openings 213 of the passage 212 communicate the plunger's interior 159 out the upper end of the connector 200. The top end 216 of the connector body 210 is also threaded to connect to a rod (e.g., 154: FIG. 3A). The connector body 210 has an edge 218 that is used in mitigating passage of sand past the connector body 210 toward the outside surface of the plunger 158.

The threaded connection 214 creates a concentricity issue between the plunger 158 and the connector body 210 and must be machined to a very close tolerance. In fact, to mitigate the travel of sand past the body 210 and its sharp edge 218, the outside surface of the connector body 210 is machined to the diameter of the plunger 158. For this reason, axial alignment of the connector 200 with the plunger 158 is crucial due to 0.002-0.005-in. typical barrel clearance typically used for downhole pumps. Additionally, the connector 200 must be made of a tough, hard material to withstand the operational depths and to resist sand scoring and corrosion. Thus, the connector 200 is restricted to particular types of materials/coatings that can be used because the components must meet particular operational constraints of hardness/toughness for the application.

The subject matter of the present disclosure is directed to overcoming, or at least reducing the effects of, one or more of the problems set forth above.

SUMMARY

As disclosed herein, a diversion connector is used for a downhole pump having a plunger and a barrel in a well. The plunger has an interior and is reciprocated by a rod relative to the barrel. The connector comprises one or more bodies and a sleeve. The one or more bodies attach the rod to the plunger. The one or more bodies have a first exterior surface and define a fluid passage communicating with the interior of the plunger. The sleeve is disposed on the first exterior surface and has an interior surface floating relative to the first exterior surface.

The connector with its fluid passage diverts fluid from the plunger's interior to the well uphole of the pump to lift wellbore fluids. For that purpose, the one or more bodies define a first opening at a first end of the one or more bodies. The first opening communicates through the fluid passage to one or more second openings disposed uphole of the sleeve toward a second end of the one or more bodies. Fluid from the plunger's interior passes through the fluid passage of the connector an exits to the wellbore through the one or more second openings.

As disclosed herein, the sleeve floating toward the uphole end of the plunger can be useful in a sandy well by at least partially prevent particulate uphole of the plunger from passing in a gap between the plunger and the barrel.

The sleeve can be composed of a different material than the one or more bodies. For example, the sleeve can be composed of a ceramic material, while the one or more bodies are composed of a metal material. The sleeve can define a first shoulder at an uphole end of the sleeve facing toward the rod. Also, the sleeve can define one or more external grooves defined about a second exterior surface thereof between the uphole end and a downhole end of the sleeve.

In one arrangement, the one or more bodies include a mandrel having first and second ends and having the first exterior surface. The second end attaches to the rod. The first end defines the fluid passage communicating toward the second end. The first end attaches to the plunger and permits fluid communication between the fluid passage of the mandrel and the interior of the plunger.

In one arrangement, the one more bodies can include a perforated body having a screen connected to the plunger.

In one arrangement, the one or more bodies can include at least one fixture attaching the mandrel to the plunger and permitting fluid communication between the fluid passage of the mandrel and the interior of the plunger. For example, the at least one fixture can include one or more rings disposed on the first end of the mandrel. A first ring can be engaged against a first shoulder on the mandrel adjacent a downhole end of the sleeve, which can have an uphole end disposed adjacent a second shoulder on the mandrel. A second ring disposed on the first end can holding the first ring against the first shoulder on the mandrel. In general, the first and second rings can thread onto the first end of the mandrel, and the second ring can thread onto the plunger.

In one arrangement, the sleeve can have a second exterior surface with an outer dimension configured to match that of the plunger. One or more biasing elements can be disposed between the interior surface of the sleeve and the first exterior surface of the one or more bodies. These one or more biasing elements can include one or more O-rings disposed between the interior surface of the sleeve and the first exterior surface of the one or more bodies. The one or more O-rings may be disposed in grooves in the first exterior surface or in the interior surface of the sleeve.

According to the present disclosure, a downhole pump is operated by a rod. The pump includes a barrel, a plunger, and a connector. The barrel has a first one-way valve permitting fluid communication into the barrel and restricting fluid communication out of the barrel. The plunger is reciprocally disposed in the barrel and has a second one-way valve. The second one-way valve permits fluid communication into an interior of the plunger from a variable volume defined between the first and second one-way valves. The second one-way valve restricts fluid communication out of the interior to the variable volume.

The first and second one-way valves can be check valves having balls movable relative to seats. In a first stroke moving the barrel and the plunger relative to one another in a first direction, the variable volume decreases, the first one-way valve closes, and the second one-way valve opens. Likewise, in a second stroke moving the barrel and the plunger relative to one another in a second direction, the variable volume increases, the first one-way valve opens, and the second one-way valve closes.

The connector attaches the rod to the plunger. The connector has a first exterior surface and defines a fluid passage communicating with the interior of the plunger. A sleeve is disposed on the connector and has an interior surface floating relative to the first exterior surface of the connector. Overall, the connector can include one or more of the features discussed previously.

The connector may attach directly to an end of the plunger, or an intermediate member can attach to an end of the plunger. The intermediate member can include a perforated body having a screen connected between the connector and the plunger.

According to the present disclosure, a downhole apparatus operates with a rod. The apparatus includes a barrel and a plunger, such as discussed above. A first end portion of the plunger has a first exterior surface and defines a first fluid passage communicating with the interior of the plunger. A first sleeve is disposed on the first end portion. This first sleeve has a first interior surface floating relative to the first exterior surface of the first end portion. The apparatus can also include a surface drive reciprocating the rod.

In one arrangement, the first end portion of the plunger can connect to the rod. The first end portion can have a connector attaching the rod to the plunger, and the connector can have features such as discussed above.

In one arrangement, a second end portion of the plunger has a second exterior surface and defines a second fluid passage communicating with the interior of the plunger. A second sleeve can be disposed on the second end portion and can have a second interior surface floating relative to the second exterior surface of the second end portion.

According to the present disclosure, a method is used for producing fluid in a sandy well. The method involves reciprocating a plunger and a barrel relative to one another. By reciprocating the plunger and the barrel relative to one another in a first direction, the method involves transferring a first volume of fluid and particulate trapped in a first interior of the barrel into a second interior of the plunger. By reciprocating the plunger and the barrel relative to one another in a second direction, the method involves lifting uphole a second volume of fluid and particulate trapped in the second interior of the plunger. The method involves at least partially preventing particulate uphole of the plunger from passing in a gap between the plunger and the barrel by floating a sleeve on an uphole end of the plunger.

The foregoing summary is not intended to summarize each potential embodiment or every aspect of the present disclosure.

DETAILED DESCRIPTION

Figures 1A, 1B:
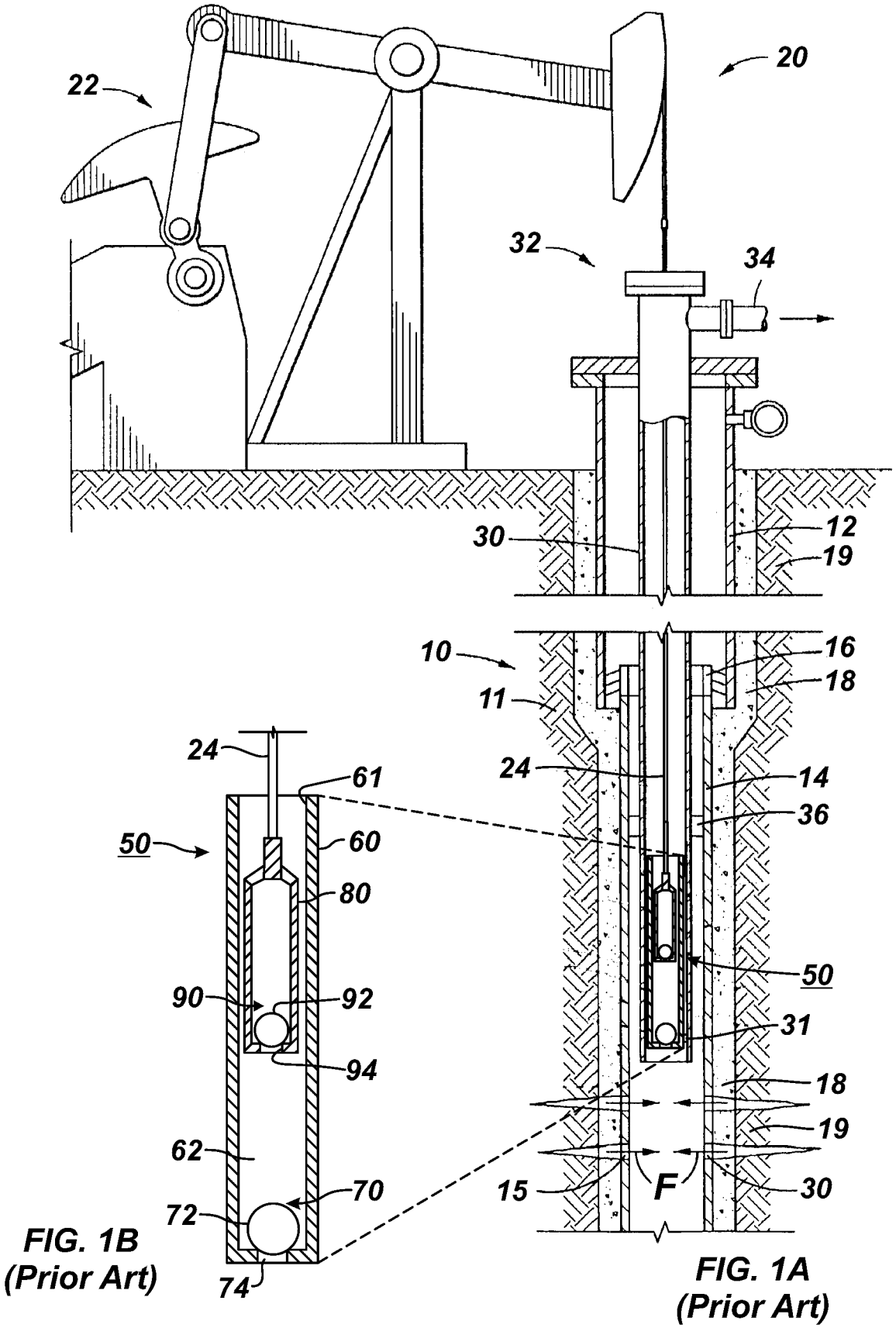
FIG. 1B (Prior Art)
FIG. 1A (Prior Art)
FIG. 1A illustrates a reciprocating rod lift system having a rod pump according to the prior art.
FIG. 1B illustrates a detailed cross-sectional view of the rod pump of FIG. 1A.
Figure 2A:
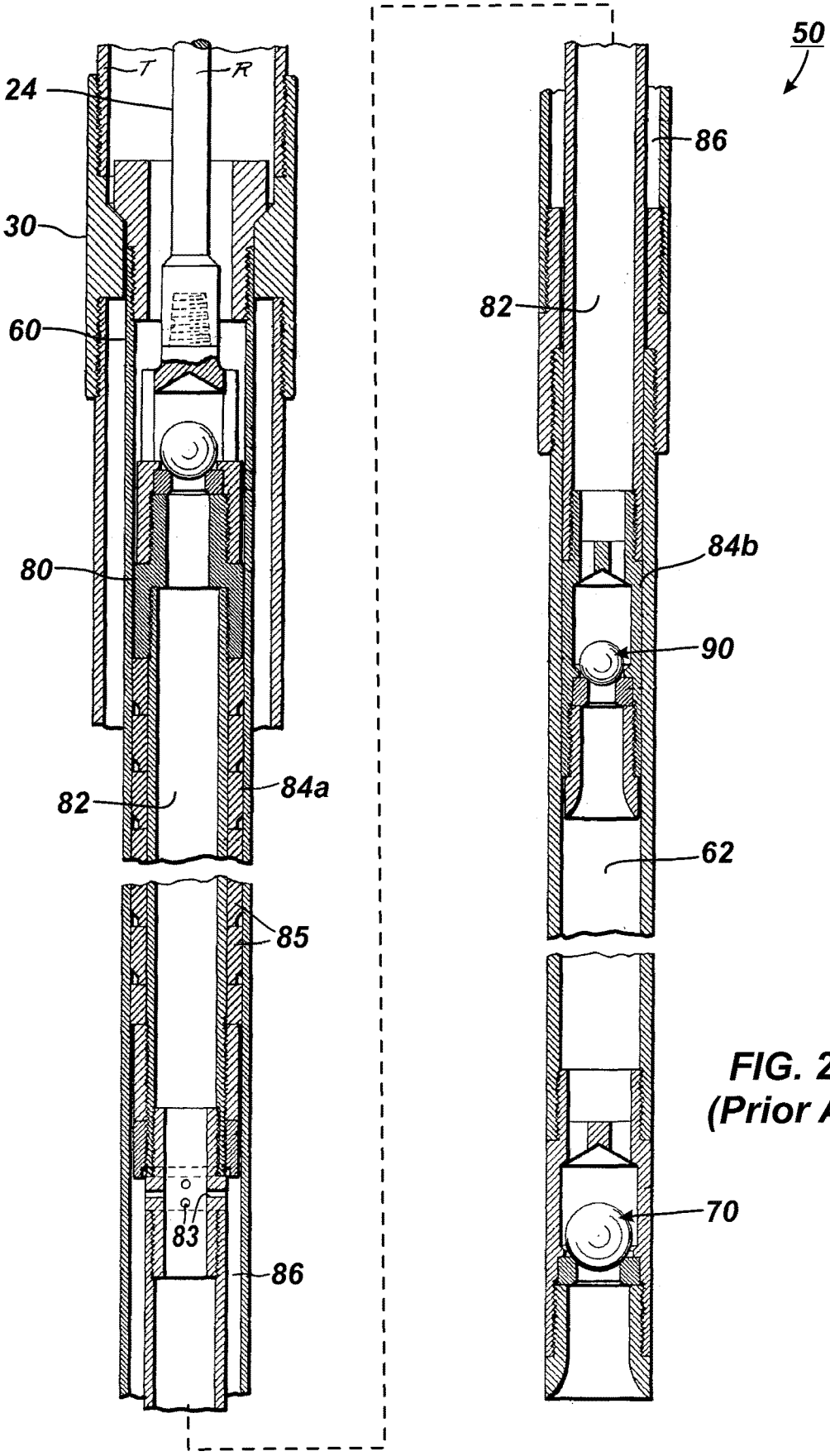
FIG. 2A (Prior Art)
FIG. 2A illustrates a rod pump having a balancing chamber according to the prior art for use in a sandy well.
Figure 2B:
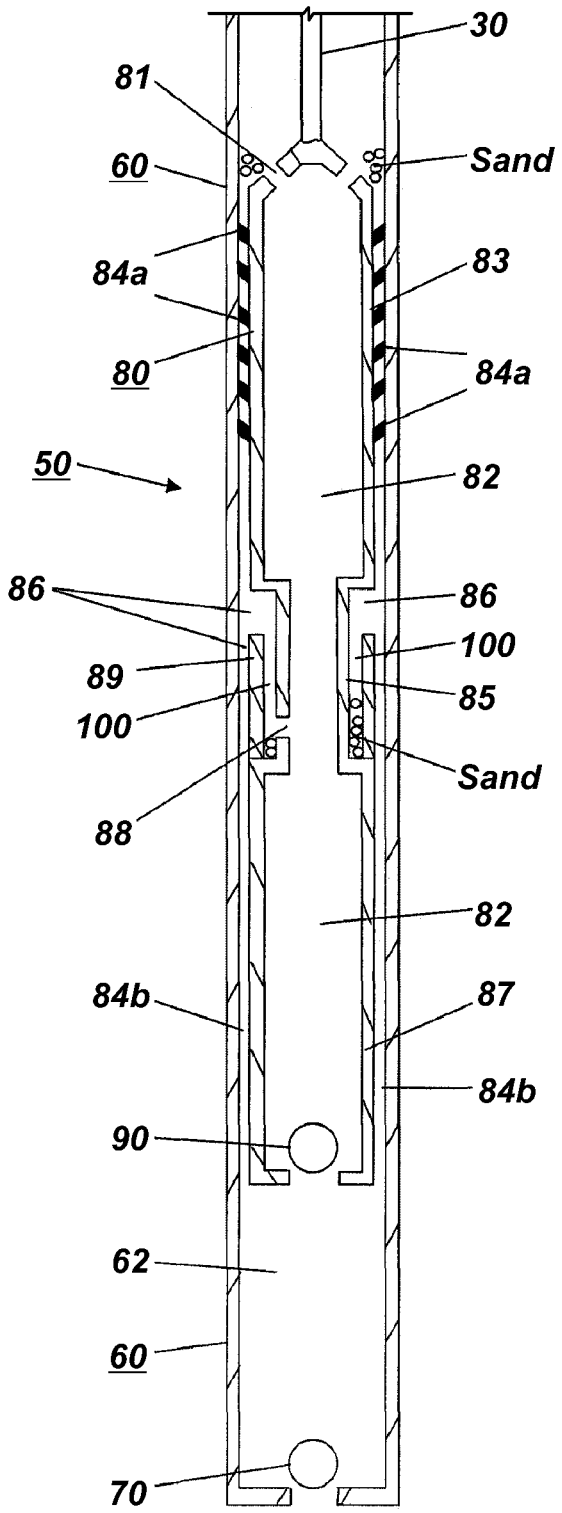
FIG. 2B (Prior Art)
FIG. 2B illustrates a rod pump having a sand snare chamber according to the prior art for use in a sandy well.
Figure 3A:
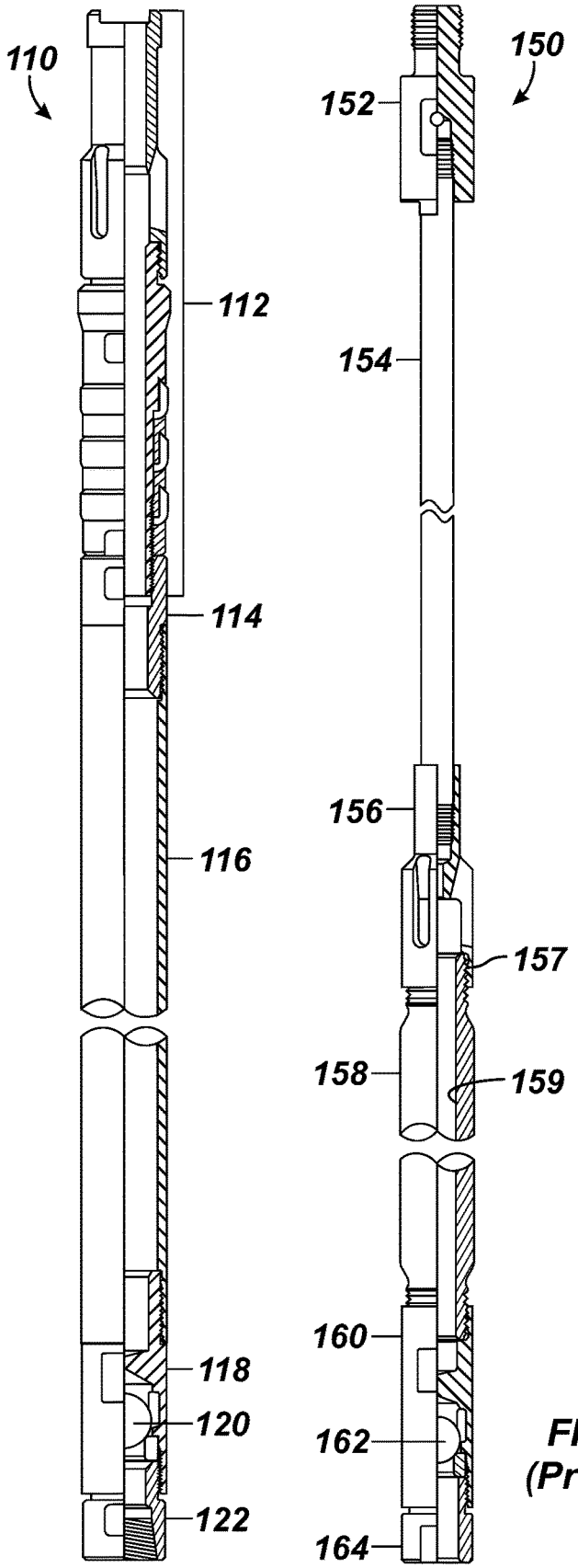
FIG. 3A (Prior Art)
FIG. 3A illustrates a rod-type pump according to the prior art.
Figure 3B:
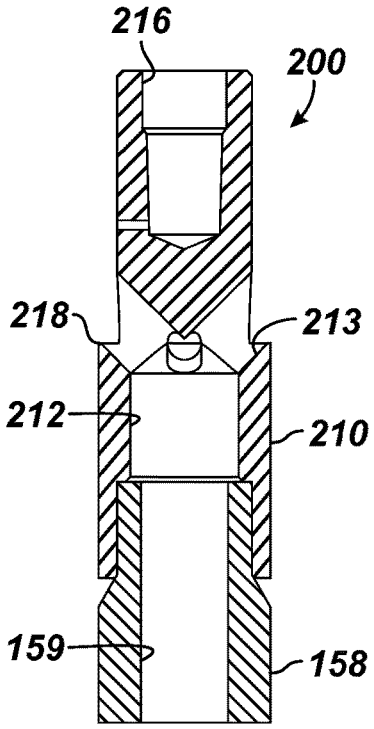
FIG. 3B (Prior Art)
FIG. 3B illustrates a diversion connector according to the prior art for a rod-type pump.
Figure 4:
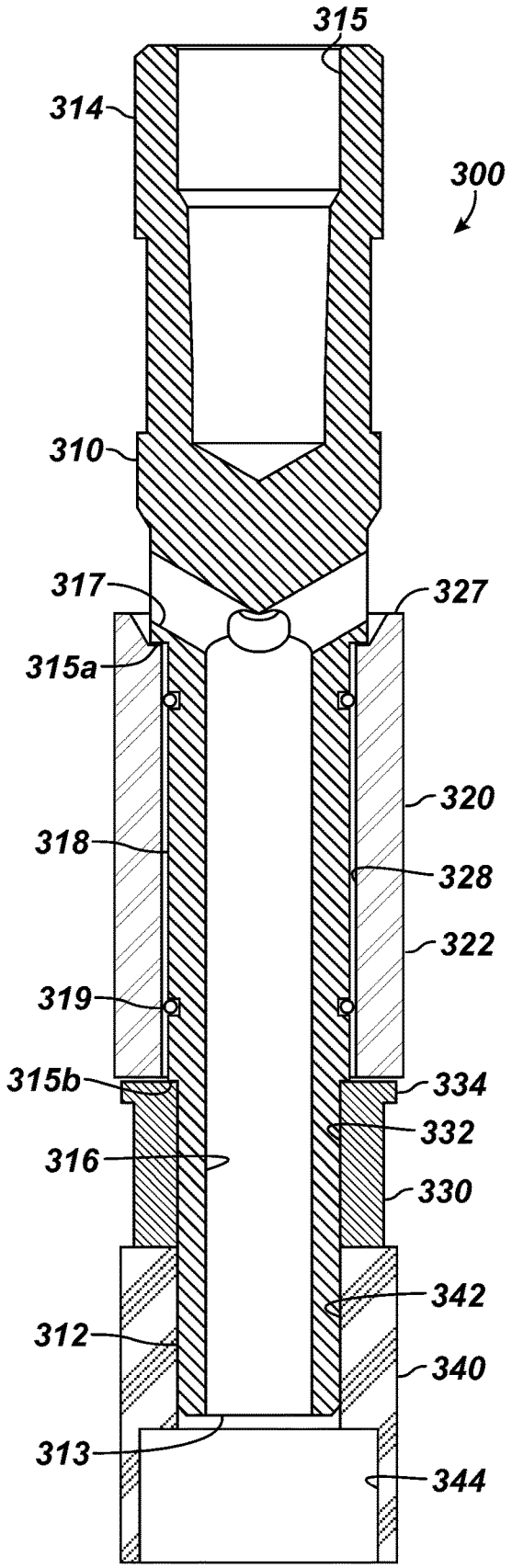
FIG. 4 illustrates a diversion connector according to the present disclosure for a rod-type pump.

FIG. 4 illustrates a diversion connector 300 according to the present disclosure in cross-section. The diversion connector 300 is used for a downhole pump having a plunger and a barrel, such as discussed previously with reference to FIG. 3A, in which the plunger (158) is reciprocated by a rod (154) relative to a barrel (116). The connector 300 connects the rod (154) to the plunger (158) and moves with the plunger (158) in the barrel (116). The connector 300 does not have to connect to the rod (154) directly. Depending on the upper connection, the connector 300 can attach to another mandrel or device, such as a wiper mandrel.

Figure 6:
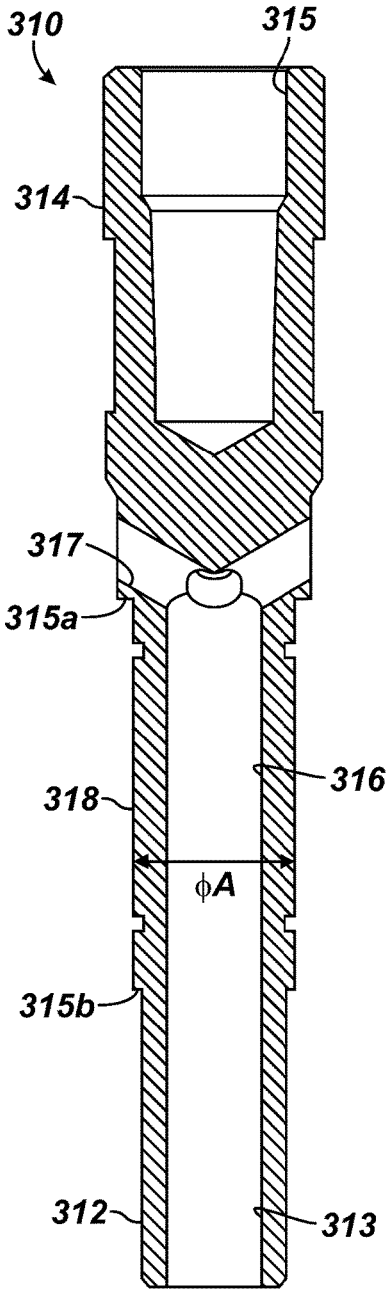
FIG. 6 illustrates the mandrel of the disclosed diversion connector.

The connector 300 has a mandrel 310, a sleeve or insert 320, and at least one fixture 330, 340. The mandrel 310, which is shown in an isolated view in FIG. 6, has ends 312, 314 and an exterior surface 318. An uphole end 314 attaches to the rod (154: FIG. 3A). The downhole end 312 defines an opening 313 for a fluid passage 316 that communicates toward exit openings 317 toward the uphole end 314.

Figure 7A:
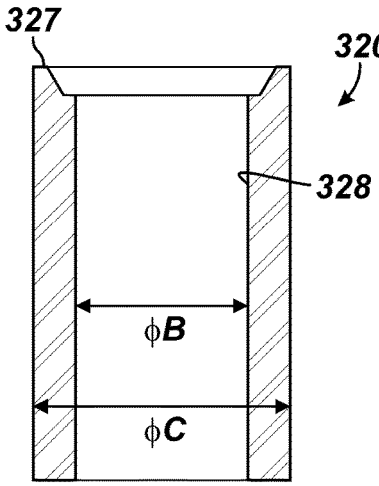
FIG. 7 illustrates the sleeve of the disclosed diversion connector.
Figure 7B:
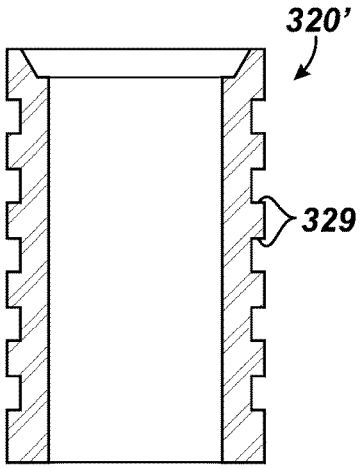

The sleeve 320 is disposed on the mandrel 310 and shoulders against an upper shoulder 315*a* of the mandrel 310. The sleeve 320, which is shown in an isolated view in FIG. 7, has an interior surface 328 that floats relative to the exterior surface 318 of the mandrel 310. The inner dimension ØB of the sleeve 320 can be approximately 0.010-in. larger than an outer dimension ØA of the mandrel's exterior surface 318. The outer dimension ØC of the sleeve 320 may typically be about 0.003-0.005-in. smaller than nominal barrel size. In general, the sleeve's exterior surface may have an outer dimension configured to match that of the plunger, although this is not strictly necessary as other configurations can be used.

Figure 8:
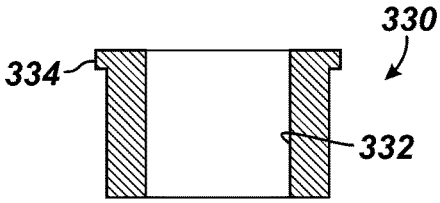
FIG. 8 illustrates the lock nut of the disclosed diversion connector.

The fixture 330, 340 attaches the downhole end 312 of the mandrel 310 to the plunger (158) and permits fluid communication between the mandrel's fluid passage 316 and the interior space (159) of the plunger (158). As shown, one of the fixtures is a first ring or lock nut 330, which is shown in an isolated view in FIG. 8. The first ring 330 has a central opening 332 that slides or threads onto the end 312 of the mandrel 310.

A shoulder 334 supports the downhole end of the sleeve 320 and preferably abuts against a shoulder 315*b* on the mandrel 310 to prevent further movement against the sleeve 320. This keeps the sleeve 320 from being tightened in place during assembly, which would prevent the sleeve 320 from moving. In fact, the first ring 330 can tighten up against the shoulder 315*b* on the mandrel 310. Even with the first ring 330 in place, the sleeve 320 can still move axially on the mandrel 310 approximately 0.020-in., if needed.

Figure 9:
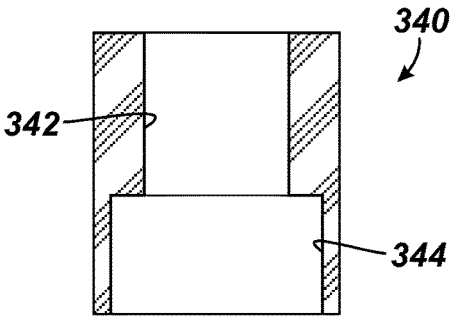
FIG. 9 illustrates the attachment nut of the disclosed diversion connector.

As shown, another of the fixtures is a second ring or attachment nut 340, which is shown in isolated view in FIG. 9. The second ring 340 has a central opening with thread 332 that threads onto the end 312 of the mandrel 310. Second threads 334 allow the second ring 340 to affix to the uphole end of the plunger (158). The second ring 340 holds the first ring 330 shouldered against the mandrel's shoulder 315*b*, and the second ring 340 is tightened against the first ring 330 to prevent either from backing off during operation.

The sleeve 320 can be composed of the same or a different material as the mandrel 310. Rather than being limited to particular materials/coatings, several materials and coatings can be used on the sleeve 320. The sleeve 320 can be made of any material that is abrasion resistant. In fact, the sleeve 320 is not limited to materials that can withstand the tensile loads typical of rod pumping. As some example, the sleeve 320 can be composed of a ceramic, a hardened stainless steel, or a metal having a hard coating or surface treatment.

As one example, the sleeve 320 can be composed of a ceramic material, and the mandrel 310 can be composed of a metal material, such as a stainless steel or a suitable alloy. The sleeve 320 just needs to be corrosion resistant and hard enough to resist sand scoring because there are no tensile loads being transmitted through it.

To mitigate sand traveling between the plunger (158) and the barrel (116), the sleeve 320 has an uphole end with a sharp edge 327. As shown, the sharp edge 327 can be a right angle corner and can have a funnel formed more toward the interior. Other edges can be used with shoulder being more or less orthogonal to the axis of the sleeve 320.

The sleeve 320 can float freely on the connector 300. Alternatively, to help with positioning of the connector 300 on the plunger (158) and relative to the barrel (116), the connector 300 can have one or more biasing elements 319 disposed between the interior surface 328 of the sleeve 320 and the exterior surface 318 of the mandrel 310. As shown, the one or more biasing elements can be O-rings 319 disposed in grooves in the exterior surface 318 of the mandrel 310 that engage against the interior surface 328 of the sleeve 320. As an alternative, the O-rings 319 can be disposed in grooves in the interior surface 328 of the sleeve 320 and can simply engage against the exterior surface 318 of the mandrel 310, or a combination of both arrangements can be used.

The sleeve 320 with its edge 327 prevents sand from getting into the gap between the working plunger (158) and barrel (116). Additionally, the sleeve 320 can float on the mandrel 310 with the aid of the O-rings 319 to allow the sleeve 320 to move radially independent of the plunger's axis and to help the sleeve 320 to locate in the barrel (116). This gives the sleeve 320 the ability to centralize in the barrel (116).

Rather than having a fixed-axis diameter, the sleeve 320 operates as a floating-axis diversion insert. In one configuration, the outer dimension OA of the mandrel 310 can be approximately 0.010-in. smaller than the inner dimension of the sleeve 320. This allows the sleeve 320 to move radially in the barrel (116) and not come in contact with the mandrel 310. With this configuration, axial alignment of the assembly to the plunger (158) is less problematic due to an approximately 0.010-in. annular clearance between the sleeve 320 and the mandrel 310. In this way, the sleeve 320 is somewhat self-aligning, and the O-rings 319 help keep the sleeve 320 centralized.

Figure 5A:
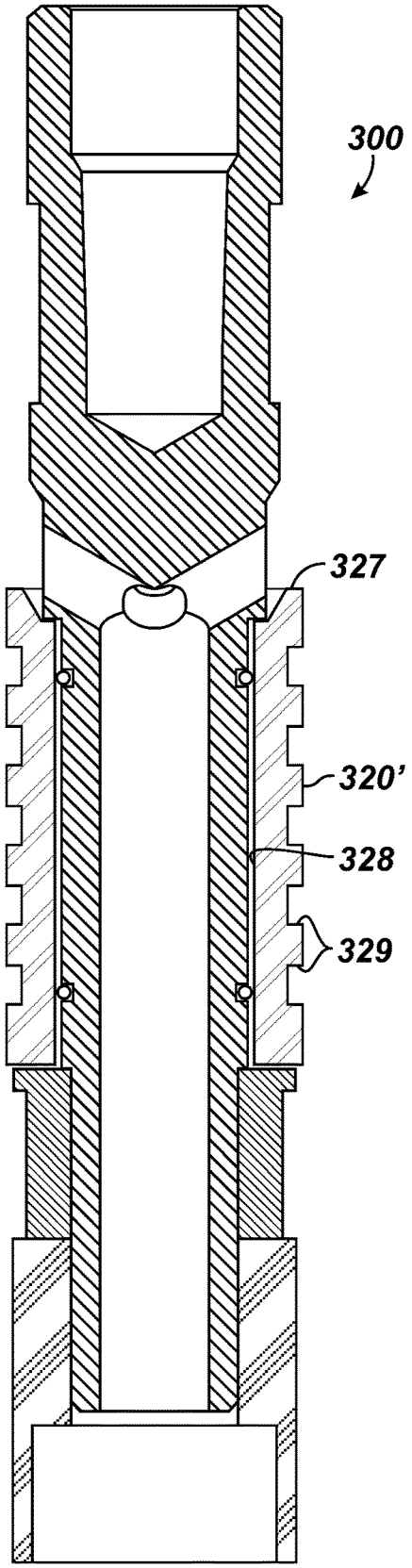
FIG. 5A illustrates another diversion connector according to the present disclosure for a rod-type pump.
Figure 5B:
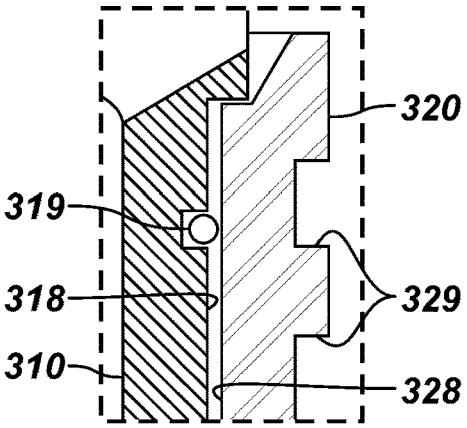
FIG. 5B illustrates a detail of the diversion connector in FIG. 5A.

As shown in FIG. 4, the sleeve 320 can be made with a smooth external surface. In another configuration, the sleeve 320 can be made with grooves in the external surface. For example, FIG. 5A illustrates another diversion connector 200 according to the present disclosure for a rod-type pump, and FIG. 5B illustrates a detail of the diversion connector's sleeve 320. In this arrangement, the sleeve 320 has one or more external grooves 329 defined circumferentially about an exterior of the sleeve 320 between the sleeve's uphole and downhole ends. As shown, multiple grooves 329 can be provided to produce a number of shoulders. The size of the grooves 329 can be consistent or different and can be uniformly or non-uniformly spaced along the sleeve 320.

In this arrangement with multiple square grooves 329, the sleeve 320 can provide multiple leading edges. Each groove 329 create a new path for any sand to traverse should the adjacent groove 329 become compromised during operation. Once the upper groove 329 is worn out from sand, for example, the groove 329 below it may be unworn and can become the new leading edge. This can continue down the length of the sleeve 320 until all of the grooves 329 are compromised.

As can be seen with reference to FIGS. 4-9, the disclosed diversion connector 300 is used in a rod pumping application that has problems with sand scoring the plunger (158) and/or barrel (116). The connector 300 is attached above the working plunger (158) and functions to divert sand away from the space between the working plunger (158) and the barrel (116) in which it reciprocates. By the strategic placement of sharp edges 327 (and optional grooves 329) and the floating exterior surface of the sleeve 320, the connector 300 can allow the sucker rod pump to operate for longer periods without damage.

Figure 10C:
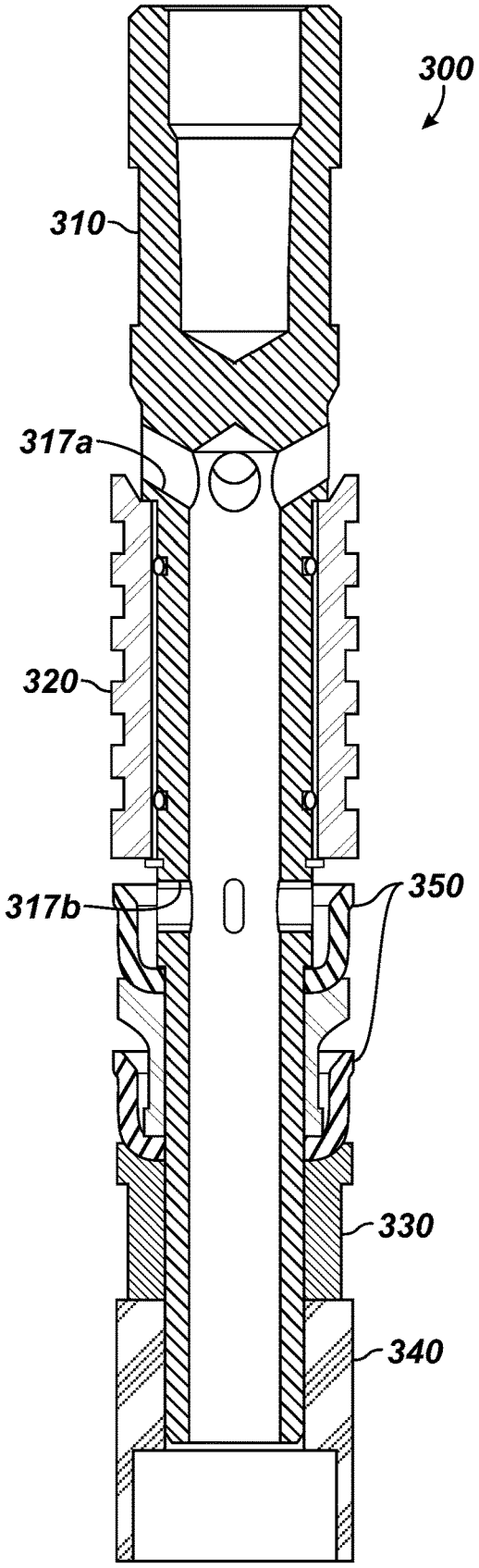
FIG. 10C illustrates the diversion connector used with wiper seals.
Figure 10A:
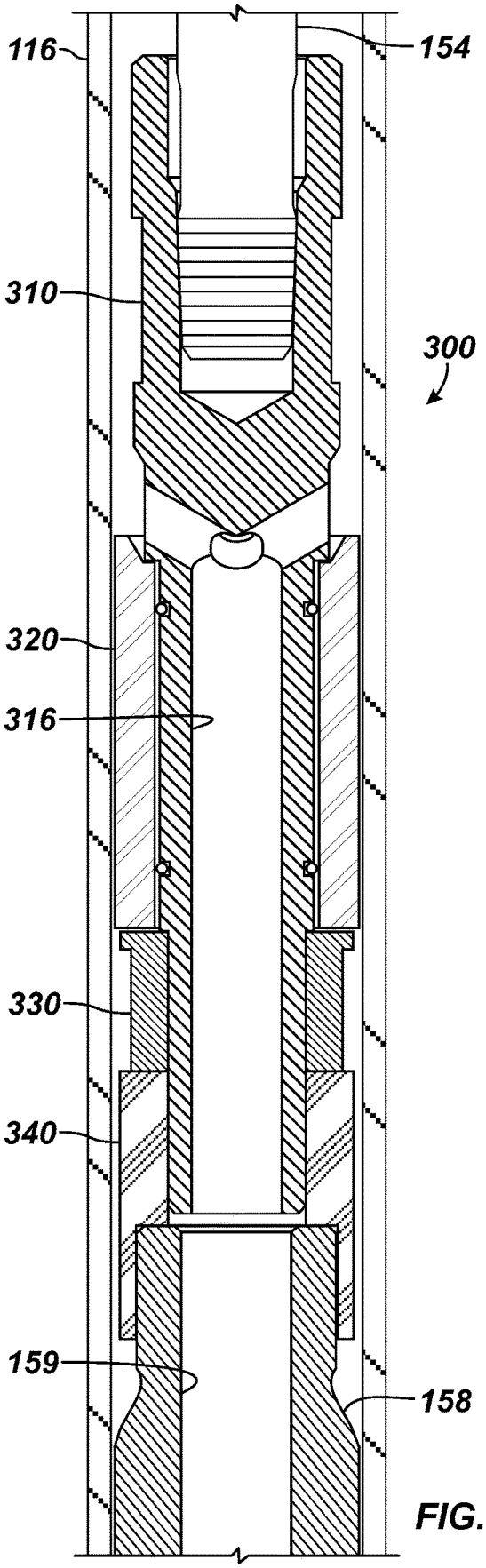
FIG. 10A illustrates the diversion connector connecting on a plunger.

As shown in FIG. 10A, the diversion connector 300 can connect directly to the plunger 158 and the rod 154 of the pump 100. In another arrangement shown in FIG. 10B, the diversion connector 300 can connect to the rod 154 and can connect to the end of the plunger 158 with an intermediate component, which can be part of the plunger 158, part of the connector 300, or independent of both.

Figure 10B:
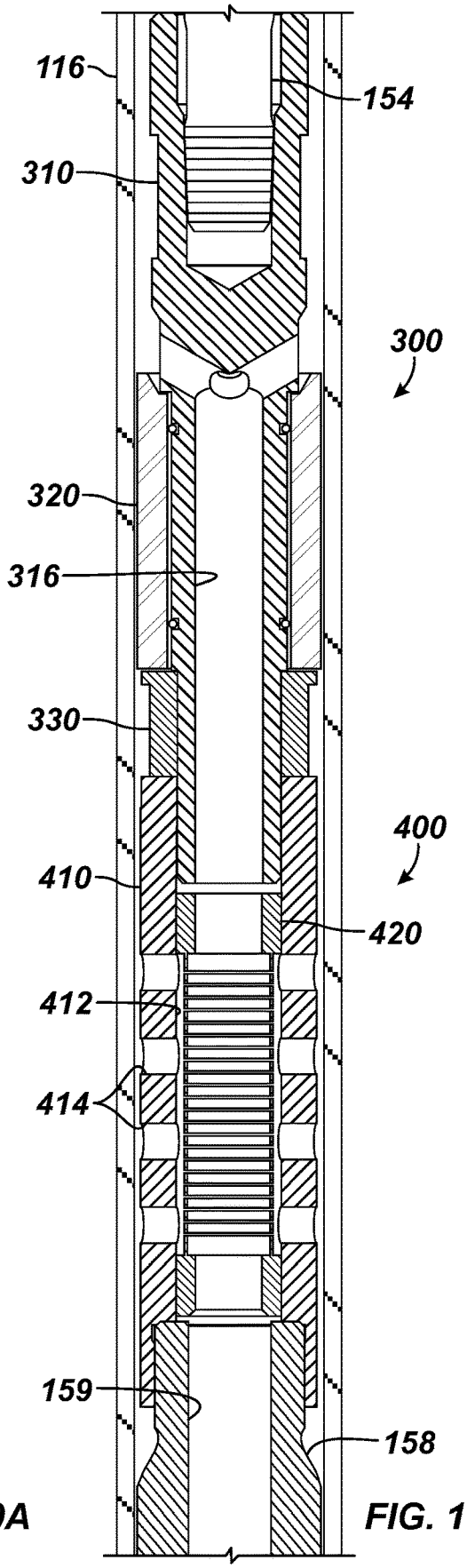
FIG. 10B illustrates the diversion connector connecting on a plunger with an intermediate component.

In FIG. 10B, for example, the intermediate component is a screen element 400 having an outer body 410 with openings 414 communicating to a central passage 412, which communicates between the flow passage 316 of the connector 300 and the interior 159 of the plunger 158. A screen 420 is inserted in the central passage 412 to create a sand barrier. This arrangement allows the pump 300 to operate in a manner similar to that disclosed in U.S. Pat. No. 8,858,187 to Lane, which is incorporated herein by reference in its entirety.

As shown in FIG. 10C, additional components can be used on the connector 300. For example, one or more wiper seals 350 can be used in conjunction with the sleeve 320 on the mandrel 310. As shown here, the sleeve 320 is disposed above upper diversion ports 317*a*. The wiper seals 350 are disposed the sleeve 320 toward the fixture elements 330, 340. The mandrel 310 can define lower diversion ports 317*b* to help with sand control. Although the wiper seals 350 are shown below the sleeve 320, an alternative arrangement can have one or more wiper seals 350 disposed on the mandrel 310 uphole of the sleeve 320. Of course, wiper seals 350 can be used both above and below the sleeve 320.

During operation, the pump 100 of any of the embodiments disclosed herein having the disclosed connector 300 may allow sand to enter the barrel 116 so it can eventually be produced with the fluid that has collected in the plunger 158. This means that produced sand collects in the lifted column of fluid above the connector 300 so the connector 300 must prevent the produced sand from entering the sealing areas between the plunger 158 and barrel 116 during operation.

During the downstroke, the sealing areas between the barrel 116 and the plunger 158 can keep produced sand from entering the gap between the plunger 158 and the barrel 116, although some sand scoring may occur on the downstroke from sand on the barrel ID wall. During the downstroke, head pressure is present inside the barrel 116 above and below the plunger 158, inside the plunger 158, and in the pressure-balance region between them. Therefore, pressure is balanced across the sealing areas between the plunger 158 and barrel 116 so that there is no slippage (i.e., fluid does not pass between the outside surfaces of the connector 300/plunger 158 and the surrounding surface of the barrel 116).

During the upstroke by the rod 154, head pressure is present inside the barrel 116 above the plunger 158. However, fluid slippage can occur in the gap between the inside of the barrel 116 and the outside surfaces of the plunger 158/connector 300. Fluid and any particles may be able to flow into the gap. Yet, as disclosed herein, the sleeve 320 and other features of the connector 300 can at least partially prevent particles, sand, and the like from entering the gap.

The upstroke and down stroke cycles are repeated, causing fluids to be lifted upward through the production tubing and ultimately to the earth's surface. Sandy fluids produced from the formation will produce less wear on the plunger 158 and barrel 116. Being able to lift the sand with the production fluids means that any produced sand below the pump will not foul a downhole screen or fill up the rathole.

In previous embodiments, the features of the connector 300 with its sleeve 320 have been used on the uphole end of the plunger 158 to prevent scoring from sand during the upstroke. As an alternative or in addition to the above arrangement, it is possible for the downhole end of the plunger 158 to include comparable features such as a sleeve to prevent scoring from sand during the downstroke.

Figure 11A:
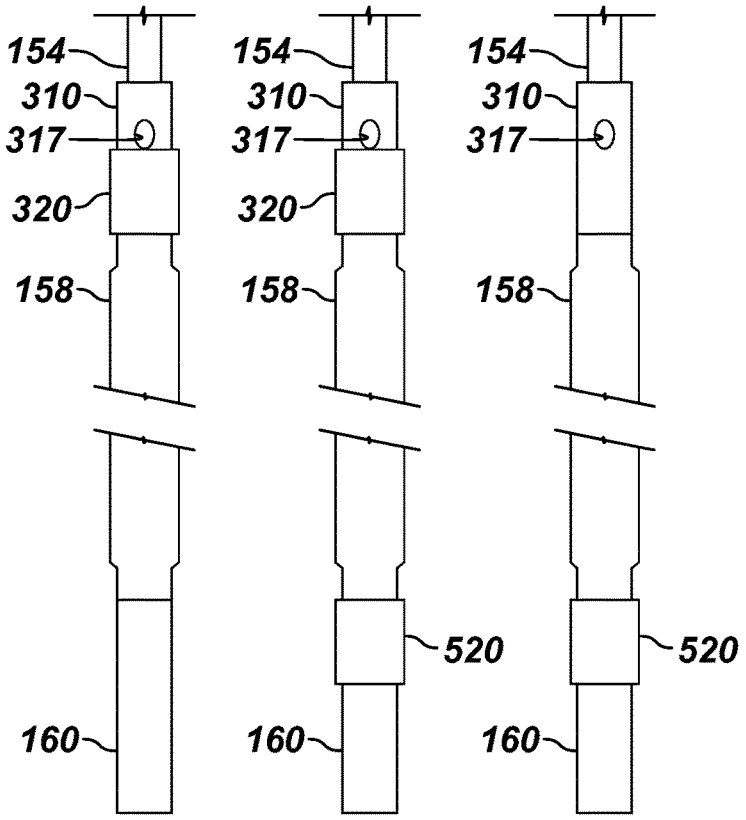
FIG. 11A illustrates several configurations for sleeves disposed on uphole and/or downhole ends of a plunger.

For example, FIG. 11A illustrates several configurations for sleeves 320, 520 disposed on uphole and/or downhole ends of a plunger 158. For the first plunger 158, a connector 300 has a mandrel 310 with ports 317. The mandrel 310 affixes to the uphole end of the plunger 158 and holds the sleeve 320 on the plunger 158. The downhole end of the plunger 158 has a cage 160.

For the second plunger 158, a connector 300 with a mandrel 310 holds the first sleeve 320 on the uphole end of the plunger 158. The cage 160 on the downhole end of the plunger also includes a sleeve 520. Finally, for the third plunger 158, a standard connector 156 with ports 157 is disposed on the uphole end of the plunger 158, while the cage 160 includes a sleeve 520.

Figure 11B:
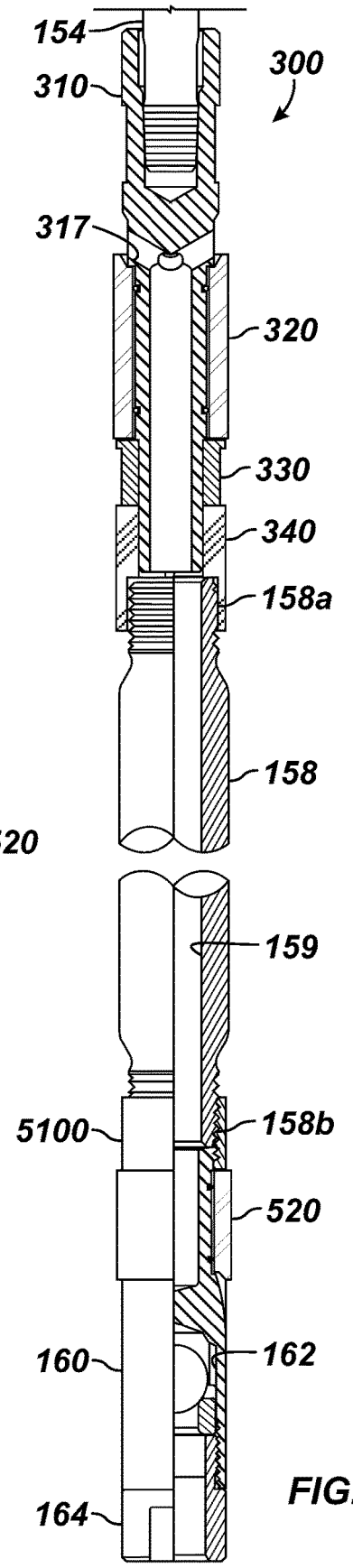
FIG. 11B illustrates one of the configurations having sleeve disposed on the uphole and downhole ends of the plunger.

FIG. 11B illustrates a particular example of the plunger 158 having sleeves 320, 520 disposed on the uphole and downhole ends of the plunger 158. A connector 300 with a mandrel 310, a sleeve 320, and fixture member(s) 330, 340 attaches to the uphole end 158*a* of the plunger 158. The cage 160 has a sleeve 520 disposed thereon and attaches to the downhole end 158*b* of the plunger 158 with a connection 510.

Figure 12A:
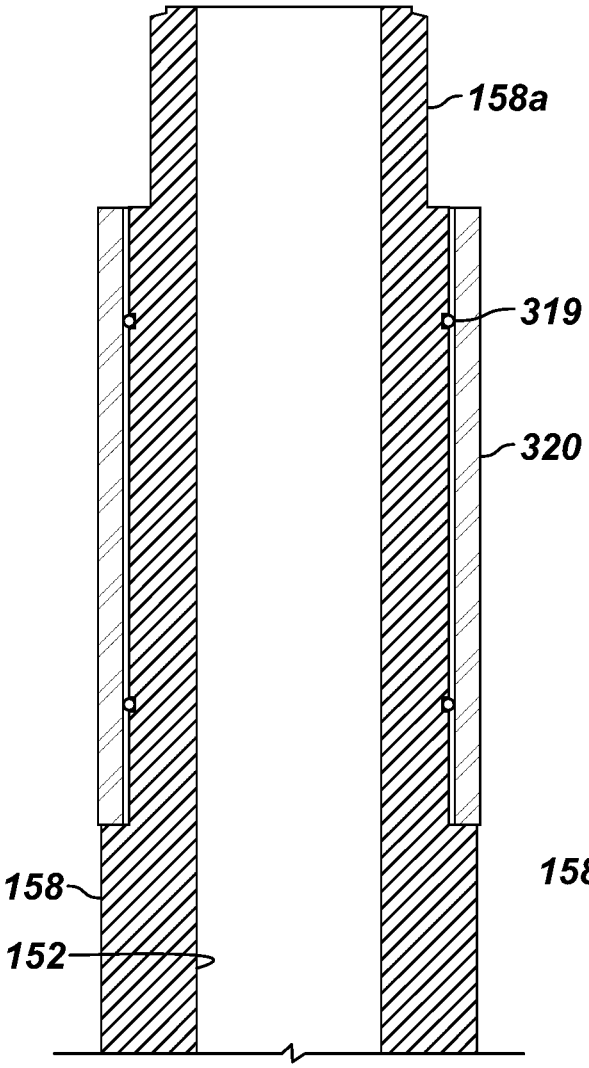
FIG. 12A illustrates an alternative arrangement of a sleeve on the end of the plunger.

In previous embodiments, the features of the connector 300 and sleeves 320 have used separate mandrels 310 attached to an end of the plunger 158. In alternative embodiments, sleeves 320/520 can be disposed directly on end portions of the plunger 158 with those end portions being integral or separately affixing elements to the plunger 158. As shown in FIG. 12A, for example, an end portion 158*a* of the plunger 158 has a sleeve 320 disposed thereon. As shown here, the end portion 158*a* has an exterior surface and defines a fluid passage 159 communicating with the interior of the plunger. The sleeve 320 is disposed on the end portion 158*a*. The sleeve 320 has an interior surface floating relative to the exterior surface of the end portion 158*a*, for example, using biasing elements 319 in a manner similar to the connectors disclosed herein.

The end portion 158*a* can be a box connector connecting to an end connector (156) having diversion ports (157). Although the uphole end portion 158*a* is shown with a sleeve 320, a downhole end portion of the plunger 158 can also have a similar configuration with an exterior surface supporting a downhole sleeve (520).

Figure 12B:
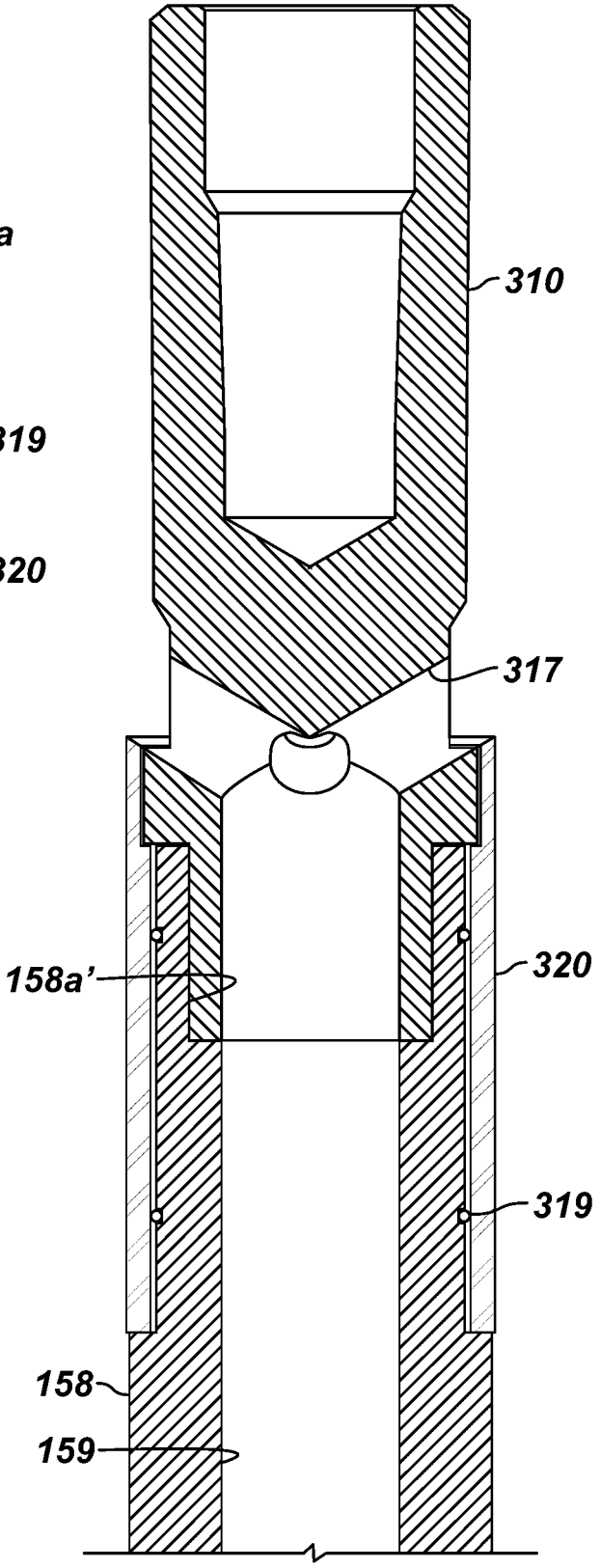
FIG. 12B illustrates a connector affixed to the end of the plunger and holding the sleeve in place.

As an example, FIG. 12B illustrates one way that a connector mandrel 310 can affix to the end portion 158*a*' of a plunger 158 and hold a sleeve 320 in place. The sleeve 320 is disposed on the exterior surface of the plunger 158 and can be supported to float with biasing elements 319. The connector mandrel 310 defines ports 317 and threads into a threaded connection of the end 158*a*' of the plunger 158. A portion of the connector mandrel 310 can support the sleeve 320 axially on the plunger 158.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus comprising a diversion connector for a downhole pump, the downhole pump having a plunger reciprocated by a rod in a barrel, the plunger having an interior, the connector comprising:

one or more bodies having a rod end attaching to the rod and having a plunger end attaching to the plunger of the downhole pump, the one or more bodies having a first exterior surface and defining a fluid passage, the fluid passage having an inlet port toward the plunger end and having at least one first outlet port toward the rod end, the inlet port communicating the fluid passage with the interior of the plunger, the at least one first outlet port communicating the fluid passage outside the first exterior surface; and a sleeve disposed on the first exterior surface between the at least one first outlet port and the plunger end of the one or more bodies and being radially movable on the first exterior surface relative to the barrel, the sleeve having an interior surface floating relative to the first exterior surface between the at least one first outlet port and the plunger end.

2. The apparatus of claim 1, wherein the sleeve is composed of a different material than the one or more bodies.

3. The apparatus of claim 2, wherein the sleeve is composed of a ceramic material, and wherein the one or more bodies are composed of a metal material.

4. The apparatus of claim 1, wherein the sleeve defines a first shoulder at an uphole end of the sleeve facing toward the rod.

5. The apparatus of claim 4, wherein the sleeve further defines one or more external grooves defined about a second exterior surface thereof between the uphole end and a downhole end of the sleeve.

6. The apparatus of claim 1, wherein the one or more bodies comprise a mandrel having the rod and plunger ends and having the first exterior surface.

7. The apparatus of claim 6, wherein the one or more bodies comprise at least one fixture attaching the mandrel to the plunger and permitting fluid communication between the fluid passage of the mandrel and the interior of the plunger.

8. The apparatus of claim 7, wherein the at least one fixture comprises a first ring disposed on the plunger end of the mandrel and engaged against a first shoulder on the mandrel adjacent a downhole end of the sleeve.

9. The apparatus of claim 8, wherein the at least one fixture further comprises a second ring disposed on the plunger end and holding the first ring against the first shoulder on the mandrel.

10. The apparatus of claim 9, wherein the first and second rings thread onto the plunger end of the mandrel; and wherein the second ring threads onto the plunger.

11. The apparatus of claim 8, wherein the sleeve has an uphole end disposed adjacent a second shoulder on the mandrel.

12. The apparatus of claim 1, wherein the sleeve has a second exterior surface with an outer dimension configured to match that of the plunger.

13. The apparatus of claim 1, further comprising one or more biasing elements disposed between the interior surface of the sleeve and the first exterior surface of the one or more bodies.

14. The apparatus of claim 13, wherein the one or more biasing elements comprises one or more O-rings disposed between the interior surface of the sleeve and the first exterior surface of the one or more bodies.

15. The apparatus of claim 14, wherein the one or more O-rings are disposed in grooves in the first exterior surface or in the interior surface of the sleeve.

16. The apparatus of claim 1, wherein the one more bodies comprise a perforated body having a screen, the perforated body connected to the plunger.

17. The apparatus of claim 1, wherein the sleeve has an uphole end adjacent the at least one fluid outlet port of the one or more bodies, the uphole end defining a conical surface angled inward.

18. The apparatus of claim 1, wherein the one or more bodies define at least one second outlet port disposed between the at least one first outlet port and the plunger end, the at least one second outlet port communicating the fluid passage outside the first exterior surface; and wherein the one or more bodies comprise at least one sealing element disposed about the first exterior surface between the at least one second outlet port and the plunger end.

19. The apparatus of claim 18, wherein the at least one sealing element comprises at least one wiper seal.

20. A downhole apparatus operated by a rod, the apparatus comprising:

a barrel having a first one-way valve permitting fluid communication into the barrel and restricting fluid communication out of the barrel;

a plunger reciprocally disposed in the barrel and having a second one-way valve, the second one-way valve permitting fluid communication into an interior of the plunger from a variable volume defined between the first and second one-way valves, the second one-way valve restricting fluid communication out of the interior to the variable volume;

a connector having a rod end attaching the rod and having a plunger end attaching to the plunger, the connector having a first exterior surface and defining a fluid passage, the fluid passage having an inlet port toward the plunger end and having at least one outlet port toward the rod end, the inlet port communicating the fluid passage with the interior of the plunger, the at least one outlet port communicating the fluid passage outside the first exterior surface; and a sleeve disposed on the connector between the at least one outlet port and the plunger end of the connector and being radially movable on the first exterior surface relative to the barrel, the sleeve having an interior surface floating relative to the first exterior surface of the connector between the at least one outlet port and the plunger end.

21. The apparatus of claim 20, wherein the first one-way valve comprises a check valve having a ball movable relative to a seat; and wherein the second one-way valve comprises a check valve having a ball movable relative to a seat.

22. The apparatus of claim 20, wherein in a first stroke moving the barrel and the plunger relative to one another in a first direction, the variable volume decreases, the first one-way valve closes, and the second one-way valve opens; and wherein in a second stroke moving the barrel and the plunger relative to one another in a second direction, the variable volume increases, the first one-way valve opens, and the second one-way valve closes.

23. The apparatus of claim 20, wherein the connector comprises a mandrel having the rod and plunger ends and having the first exterior surface; and wherein the sleeve is disposed on the mandrel.

24. The apparatus of claim 20, wherein the plunger end of the connector attaches directly to an upper end of the plunger.

25. The apparatus of claim 20, comprising an intermediate member attaching the plunger end of the connector to an upper end of the plunger.

26. The apparatus of claim 25, wherein the intermediate member comprises a perforated body having a screen, the perforated body connected between the plunger end of the connector and the upper end of the plunger.

27. The apparatus of claim 20, comprising a surface drive reciprocating the rod.

28. The apparatus of claim 20, wherein the sleeve has an outer dimension configured to match that of the plunger.

29. The apparatus of claim 20, further comprising one or more biasing elements disposed between the interior surface of the sleeve and the first exterior surface of the connector.

30. A downhole apparatus operating with a rod, the apparatus comprising:

a barrel having a first one-way valve permitting fluid communication into the barrel and restricting fluid communication out of the barrel;

a plunger reciprocally disposed in the barrel and having a second one-way valve, the second one-way valve permitting fluid communication into an interior of the plunger from a variable volume defined between the first and second one-way valves, the second one-way valve restricting fluid communication out of the interior to the variable volume;

a first end portion of the plunger having a first exterior surface and defining a first fluid passage, the first fluid passage communicating with the interior of the plunger, the first end portion defining a first fluid port, the first fluid port communicating the first fluid passage outside the first end portion; and a first sleeve disposed on the first end portion between the first fluid port and the plunger and being radially movable on the first exterior surface relative to the barrel, the first sleeve having a first interior surface floating relative to the first exterior surface of the first end portion between the first fluid port and the plunger; and one or more first biasing elements disposed between the first interior surface of the first sleeve and the first exterior surface of the first end portion.

31. The apparatus of claim 30, wherein the first end portion is disposed on an uphole end of the plunger and connects to the rod, the first fluid port being in communication with an outlet for the plunger.

32. The apparatus of claim 31, wherein the first end portion comprises a connector attaching the rod to the plunger; and wherein the first sleeve is disposed on the connector.

33. The apparatus of claim 31, further comprising:

a second end portion disposed on a downhole end of the plunger, the second end portion having a second exterior surface and defining a second fluid passage, the second fluid passage communicating with the interior of the plunger, the second end portion defining a second fluid port, the second fluid port communicating the second fluid passage outside the second end portion; and a second sleeve disposed on the second end portion between the second fluid port and the plunger and being radially movable on the second exterior surface relative to the barrel, the second sleeve having a second interior surface floating relative to the second exterior surface of the second end portion between the second fluid port and the plunger.

34. The apparatus of claim 30, wherein the first end portion is disposed on a downhole end of the plunger, the first fluid port being an inlet for the plunger.

35. The apparatus of claim 34, wherein first fluid port of the first end portion communicates with the second one-way valve.

36. The apparatus of claim 33, wherein the second fluid port of the second end portion communicates with the second one-way valve.

37. The apparatus of claim 30, wherein the first sleeve has an outer dimension configured to match that of the plunger.

38. The apparatus of claim 33, further comprising one or more second biasing elements disposed between the second interior surface of the second sleeve and the second exterior surface of the second end portion.

39. A method of producing fluid in a sandy well, the method comprising:

reciprocating a plunger and a barrel relative to one another;

transferring a first volume of fluid and particulate trapped in a first interior of the barrel into a second interior of the plunger by reciprocating the plunger and the barrel relative to one another in a first direction;

lifting uphole a second volume of fluid and particulate trapped in the second interior of the plunger by reciprocating the plunger and the barrel relative to one another in a second direction; and at least partially preventing particulate uphole of the plunger from passing in a gap between the plunger and the barrel by floating an interior surface of a first sleeve on a first exterior surface disposed between at least one outlet port and an uphole end of the plunger and radially moving the floating first sleeve on the first exterior surface relative to the barrel.

40. The method of claim 39, further comprising floating a second sleeve on a downhole end of the plunger and radially moving the floating second sleeve on a second exterior surface of the downhole end of the plunger relative to the barrel.

41. The apparatus of claim 39, wherein floating the interior surface of the first sleeve on the first exterior surface disposed between the at least one outlet port and the uphole end of the plunger comprises floating the first sleeve with one or more biasing elements disposed between the interior surface of the first sleeve and the first exterior surface.

* * * * *